US006527220B2

(12) United States Patent
Weaver et al.

(10) Patent No.: US 6,527,220 B2
(45) Date of Patent: Mar. 4, 2003

(54) KNOCKDOWN, CHANGEABLE REEL SYSTEM AND METHOD

(75) Inventors: Dustin H. Weaver, Whitesboro; Thomas L. Yoast, Gainesville, both of TX (US)

(73) Assignee: Petroflex, N.A., Inc., Gainesville, TX (US)

( * ) Notice: Subject to any disclaimer, the term of this patent is extended or adjusted under 35 U.S.C. 154(b) by 0 days.

(21) Appl. No.: 09/730,118

(22) Filed: Dec. 6, 2000

(65) Prior Publication Data

US 2002/0066821 A1 Jun. 6, 2002

(51) Int. Cl.[7] ..... B65H 75/18; B65H 75/14

(52) U.S. Cl. ..... 242/603; 242/608; 242/608.2; 242/607.1; 242/607.2; 242/571; 242/578

(58) Field of Search ..... 242/603, 604.1, 242/604, 608, 608.6, 608.2, 608.5, 607.2, 602, 602.1, 571, 578, 578.2

(56) References Cited

U.S. PATENT DOCUMENTS 1,411,098 A * 3/1922 Horton
4,620,676 A * 11/1986 Missalla ..... 242/115

* cited by examiner

*Primary Examiner*—Donald P. Walsh
*Assistant Examiner*—Jonathan R Miller
(74) *Attorney, Agent, or Firm*—Chase Law Firm, L.C.; Mark E. Brown

(57) ABSTRACT

A reel for use with flaccid material, such as cables, conduits or the like, includes flanges that are connected together by an adjustable hub. The hub is formed of a plurality of crossbeams that are releasably connected to the flanges whereby the reel can be disassembled for shipping and/or storage and re-assembled in a wide variety of configurations to have a variety of hub dimensions and a variety of compartments.

16 Claims, 9 Drawing Sheets

KNOCKDOWN, CHANGEABLE REEL SYSTEM AND METHOD

BACKGROUND OF THE INVENTION

It is conventional practice in the winding, tensioning and guiding art to ship elongate materials, such as cable, wire, flaccid conduits, or the like wound on reels. A purchaser or user then unwinds the material from the reel.

The basic structure of a reel in this art includes a hub and two end flanges with the material being wound around the hub and stored in a compartment defined between the flanges. The material is dispensed from the reel by being unwound from the hub.

In some cases, the reel can be returned to the manufacturer for re-use. However, in some situations, the reel is so large that it is not economical to ship the empty reel back. In such situations, the empty reel presents a problem. It cannot be simply left at the site; however, shipping the empty reel anywhere presents an expense and a problem.

An example of this problem is associated with the placement of fiber optic cables. In this situation, large hollow conduits are first placed, and then fiber optic cables are then inserted into the hollow conduits. As is known in the art, such cable placement can extend for great distances, perhaps many miles. Several miles of conduit will require many large reels. From the above discussion, it will be appreciated that the disposal of reels associated with this procedure can present a significant problem.

Therefore, there is a need for a reel that can accommodate large amounts of material and can be efficiently removed from a site upon completion of a material dispensing procedure.

Still further, many overall projects require several different sizes of material. The different sizes can include not only different outer perimeters for the materials, but different lengths as well. The different lengths of material can be used for runs that are of different lengths from a main, overall, long run of the material.

Therefore, there is a need for a reel that can accommodate large amounts of different size material and can be efficiently removed from a site upon completion of a material dispensing procedure.

Still further, many large reels can be expensive to manufacture. Therefore, it will be most cost effective to use a reel in as many different situations as possible.

Therefore, there is a need for a reel that can accommodate large amounts of material and can be efficiently removed from a site upon completion of a material dispensing procedure and which is adaptable to a wide variety of requirements and uses.

Still further, reels must be stored between uses. Large reels will require large amounts of storage area. This can be expensive and is not efficient.

Therefore, there is a need for a reel that can accommodate large amounts of material and can be efficiently removed from a site upon completion of a material dispensing procedure and which can be efficiently stored when not in use.

While the art contains many example of reels suitable for storing flaccid material, such as fiber optic cable conduits, these known reels are not easy to dispose of after use. Furthermore, these known reels are not amendable to efficient modification to meet changed requirements. The reel, once manufactured, can be used only for storing and/or dispensing material that is within a narrow range of sizes.

Known reels are also quite difficult to store efficiently as they are often quite large and/or heavy and bulky.

Therefore, known reels are not only inefficient to store and dispose of, they are not cost effective.

Still further, many known reels are job specific in that a reel is manufactured for a particular use and/or material, and is not easily changed to satisfy other requirements. As such, these reels are not cost efficient.

Therefore, there is a need for a reel that can accommodate large amounts of material and can be efficiently removed from a site upon completion of a material dispensing procedure, and which can be easily set up and modified for a wide variety of different needs.

Still further, the component parts of many known reels are welded together to form the reel. This makes assembly and disassembly very difficult.

SUMMARY OF THE INVENTION

These, and other, objects are achieved by knockdown reel that includes at least two flanges releasably coupled together by a changeable hub. The hub is adjustable to define different outer perimetric hub dimensions as well as to accommodate more than two flanges for defining a number of compartments.

The reel of the present invention can be disassembled between uses so it can be efficiently shipped to or from a desired location as well as efficiently stored.

Still further, the adjustable nature of the reel permits it to efficiently accommodate a wide variety of material sizes, shapes and other characteristics and requirements. This makes the reel very cost effective.

Since the reel is formed of a number of interchangeable parts, it can be reconfigured for a particular job without requiring special manufacturing of special parts. This further increases the cost-efficiency of the reel. The reel is very easily assembled and disassembled and does not require welding or the like to assemble. Therefore, set up and knockdown are easily carried out.

TECHNICAL FIELD OF THE INVENTION

The present invention relates to the general art of winding, tensioning and guiding, and to the particular field of coil holders and supports such as a spool or core.

OBJECTS AND ADVANTAGES OF THE INVENTION

It is a main object of the present invention to provide a reel that can accommodate large amounts of material and can be efficiently removed from a site upon completion of a material dispensing procedure.

It is another object of the present invention to a reel that can accommodate large amounts of different size material and can be efficiently removed from a site upon completion of a material dispensing procedure.

It is another object of the present invention to provide a reel that can accommodate large amounts of material and can be efficiently removed from a site upon completion of a material dispensing procedure and which is adaptable to a wide variety of requirements.

It is another object of the present invention to provide a reel that can accommodate large amounts of material and can be efficiently removed from a site upon completion of a material dispensing procedure and which can be efficiently stored when not in use.

It is another object of the present invention to provide a reel that can accommodate large amounts of material and can be efficiently removed from a site upon completion of a material dispensing procedure and which is formed of a number of identical parts which can be easily assembled to form a wide variety of different reels that can satisfy a wide range of different requirements.

It is another object of the present invention to provide a reel that can accommodate large amounts of material and can be efficiently removed from a site upon completion of a material dispensing procedure and which is formed of a number of parts which can be easily assembled and disassembled and combined in a number of different ways to provide a number of different configurations.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof

BRIEF DESCRIPTION OF THE DRAWING FIGURES

DETAILED DESCRIPTION OF THE PREFERRED EMBODIMENT OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Other objects, features and advantages of the invention will become apparent from a consideration of the following detailed description and the accompanying drawings.

Figure 1:
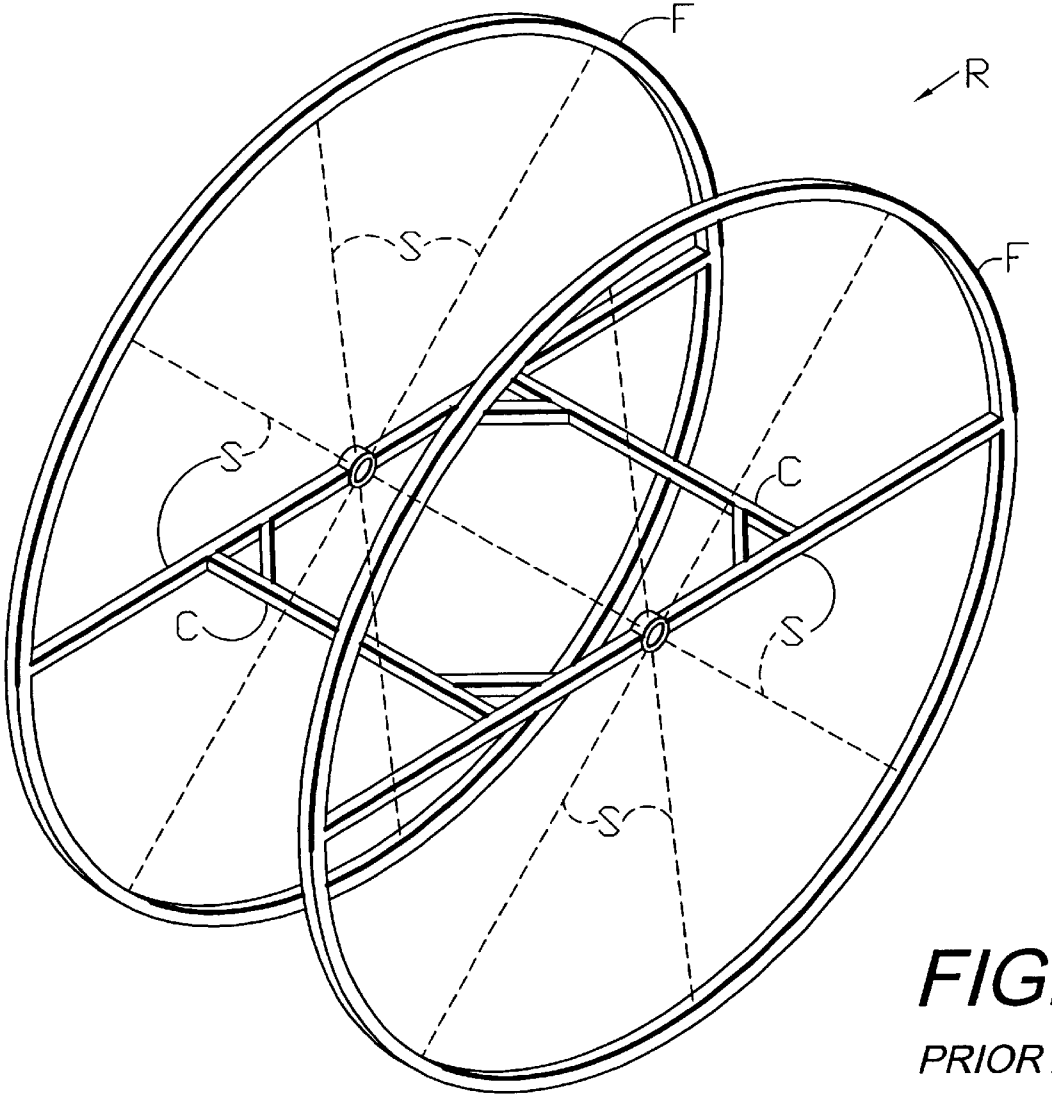
FIG. 1 PRIOR ART
FIG. 1 is a perspective view of a prior art reel.

By way of orientation, reference is first made to FIG. 1 which shows a prior art reel R that is commonly used in storing and dispensing flaccid material such as cables or conduits. Reel R includes two flanges F connected together by a plurality of crossbeams C that are fixedly attached to spokes S of flanges F as by welding or the like.

While reel R works well for some purposes, it has many of the drawbacks discussed above, principal of which is the drawback that it is not adaptable to changing configurations and cannot be disassembled for storage and/or shipment.

Figure 2:
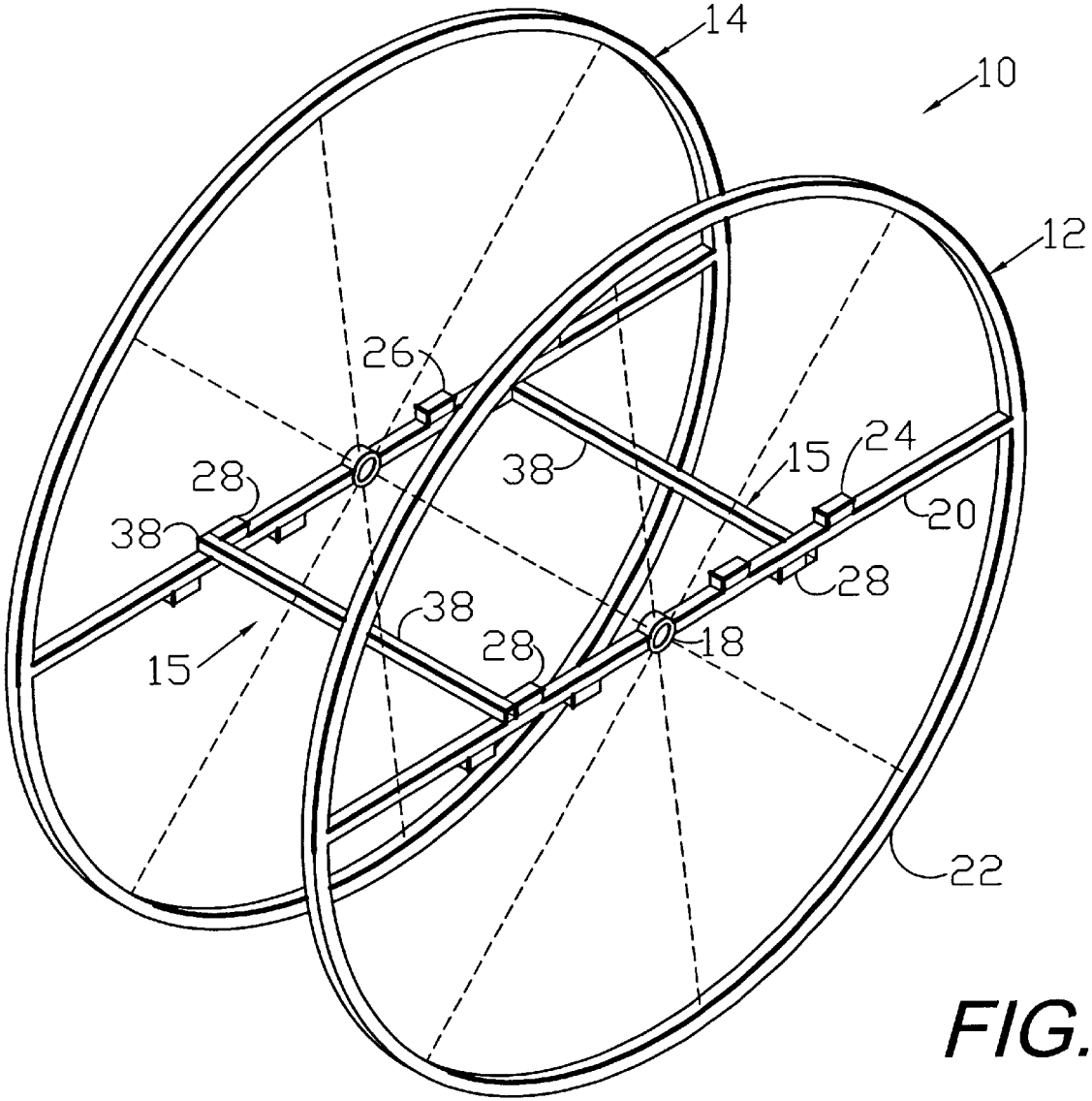
FIG. 2 is a perspective view of the reel embodying the present invention.
Figure 3:
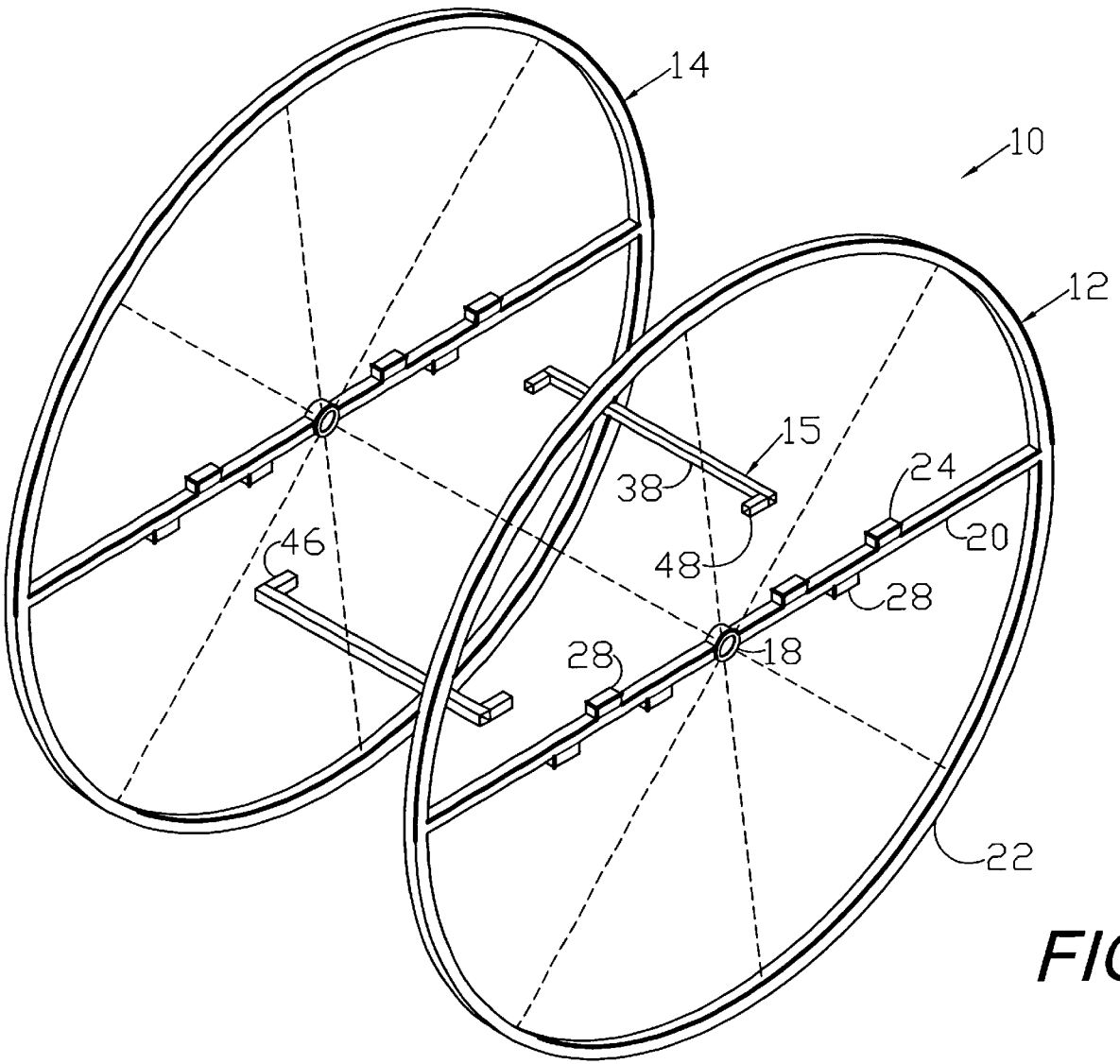
FIG. 3 is an exploded perspective view of the reel embodying the present invention.

A reel 10 embodying the present invention is shown in FIGS. 2 and 3 and can be collapsed, or knocked down, for shipment and/or storage and is amenable to efficient modification whereby a variety of different configurations can be defined to meet different conditions and requirements.

Reel 10 includes two flanges 12 and 14, which can be identical but need not be, connected together by a changeable and adjustable hub 15 to define a compartment 16 between the flanges for storing, dispensing and/or collecting flaccid materials, such as cables, conduits or the like. As will be discussed in more detail below, reel 10 is adaptable to different size hubs, different size compartments and a plurality of compartments, including two, three or more, each of which can have its own dimensions for compartment size and/or hub size.

Figure 4:
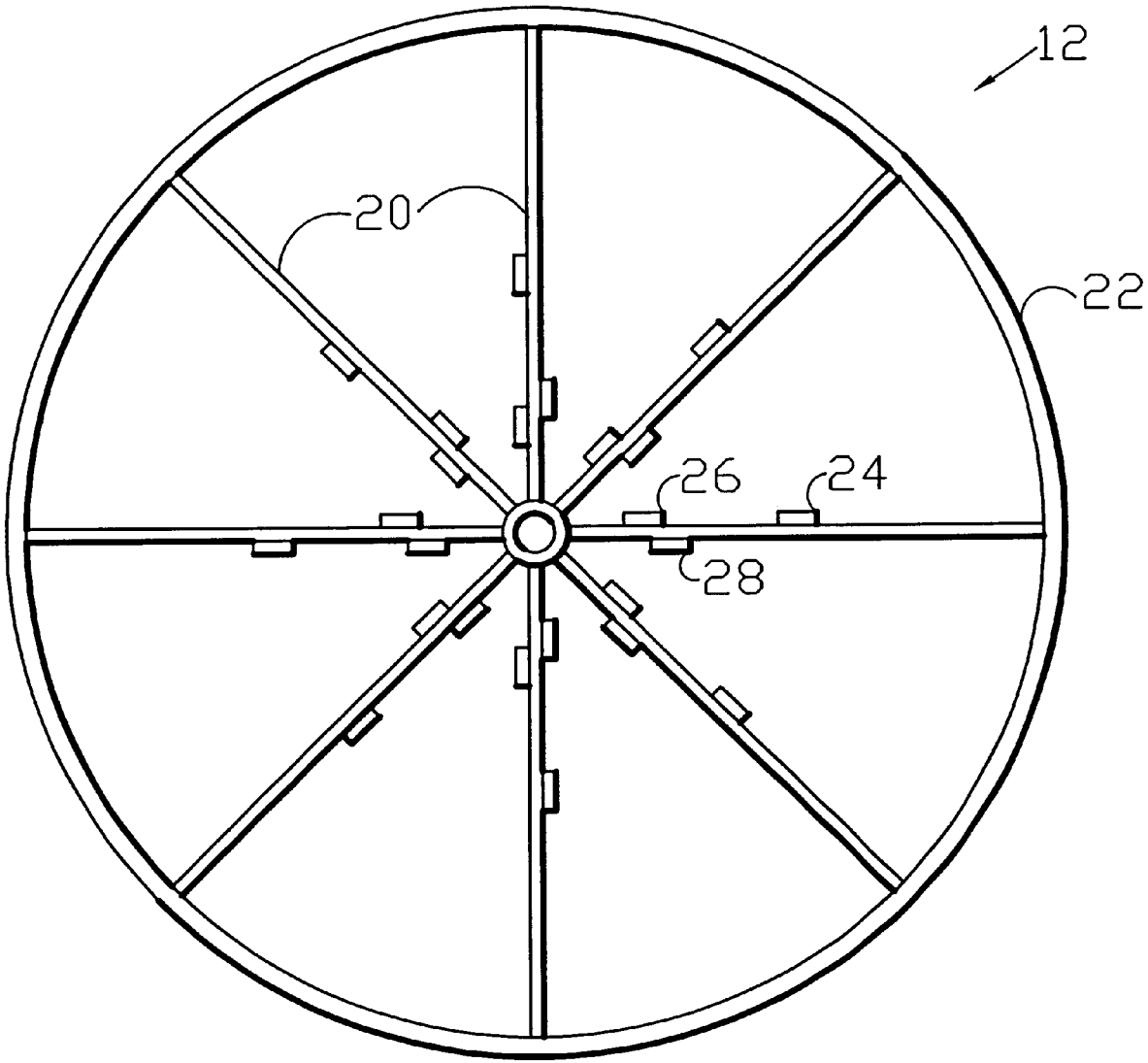
FIG. 4 is an elevational view of one flange of the reel of the present invention.
Figure 4A:
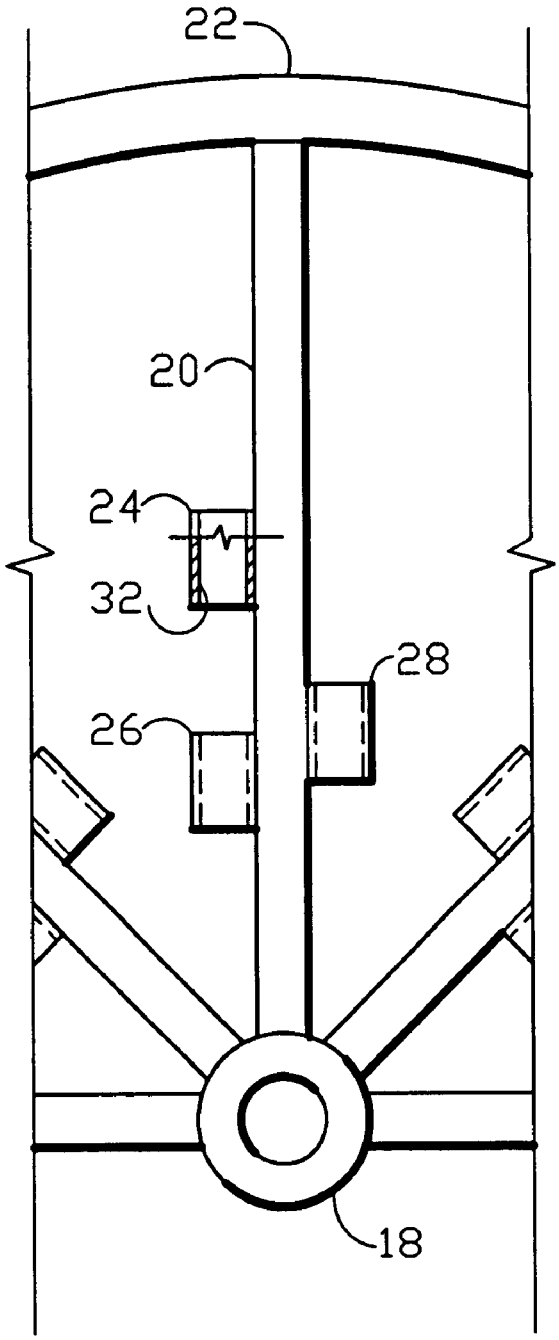
FIG. 4A is an enlarged, side elevational view of a portion of the flange shown in FIG. 4.

Referring to FIGS. 2, 3 and 4, it is seen that a flange 12 includes a central location 18 which can be a bushing or the like to accommodate an axle if desired, and a plurality of spokes 20 extending radially outwardly from the central location 18 to a perimeter element 22. Each spoke 20 has fixedly mounted thereon in radially spaced relation hollow sleeves or mounts 24 and 26. A respective hollow sleeve or mount 28 is mounted on the other side of each spoke 20. On each spoke 20 respective sleeves 24 and 28 are both radially spaced and circumferentially spaced with respect to each other. Each sleeve has a hollow body 30 defining a central bore 32 therethrough with an open outer end 34 (FIGS. 4A and 6).

Figure 5A:
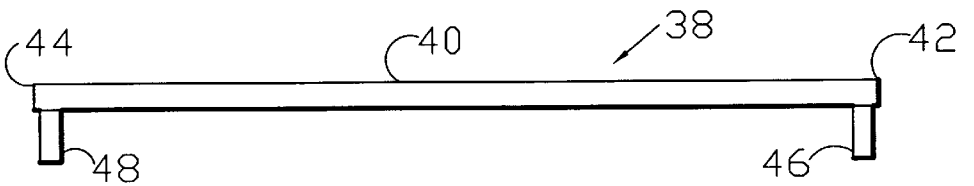
FIG. 5A is an elevational view of one crossbeam used in the reel of the present invention.

Referring to FIGS. 3 and 5A, one form of the reel of the present invention includes a plurality of crossbeams 38. Each crossbeam includes an elongate body 40 having two ends 42 and 44, with projections 46 and 48 located adjacent to the each of the ends 42 and 44 respectively. The preferred form of the crossbeams includes projections that are oriented at a right angle with respect to the body. As will be understood from FIG. 3, this relative orientation between the projections and the body of each crossbeam orients the projections along the longitudinal direction of each spoke, or radially with respect to the flange associated with the spoke to which the crossbeam projection is attached. The preferred orientation of the projections is radially toward central area 18 of each flange.

Figure 6:
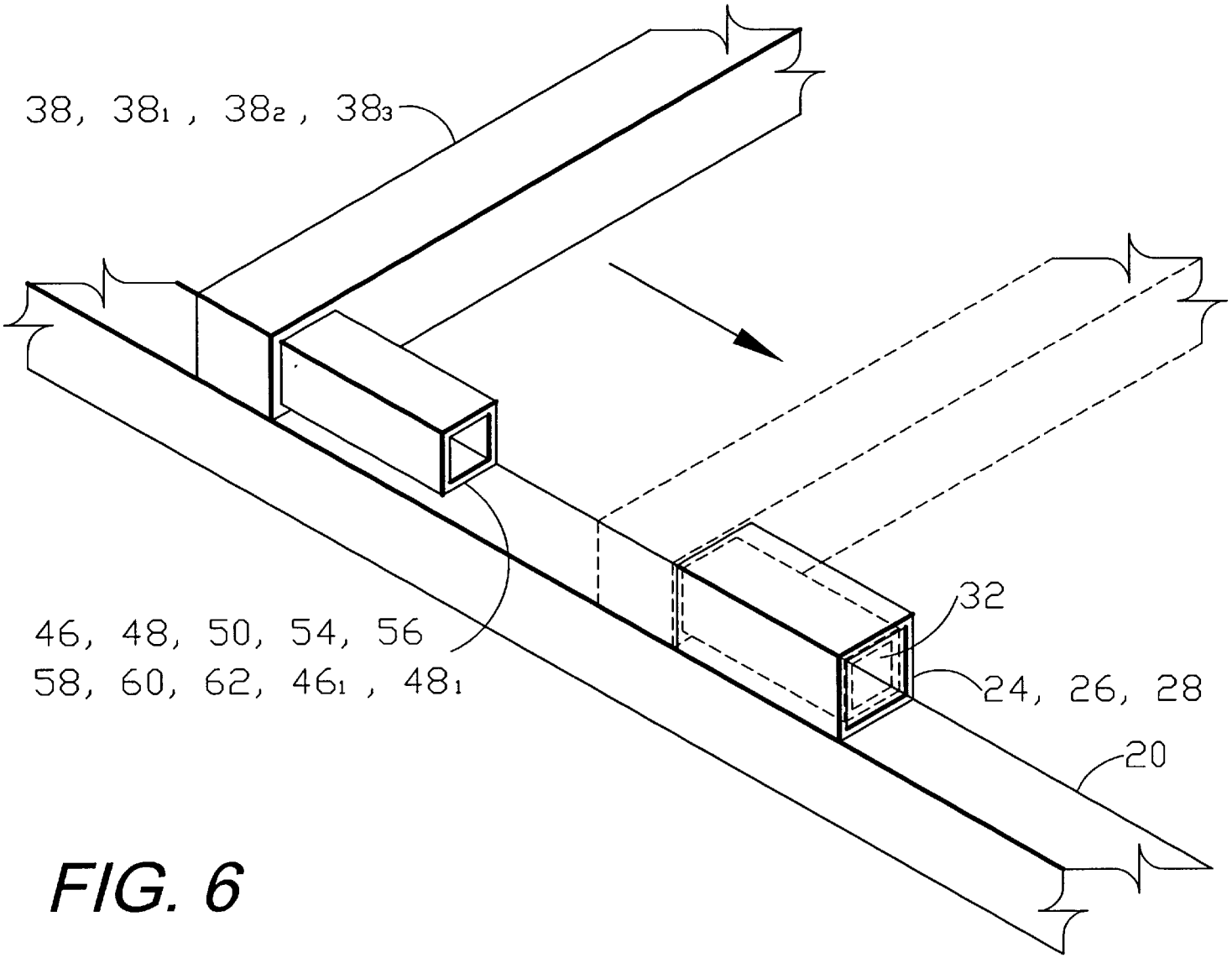
FIG. 6 shows a portion of a spoke of a flange with a crossbeam being moved into connection with the spoke.

Each projection is slidably received in a bore of a sleeve via the open end of the sleeve as will be understood by comparing FIGS. 3 and 4 as well as referring to FIG. 6 which clearly shows a projection on an end of a crossbeam being slidably received in a bore of a spoke-mounted sleeve via an open end of that bore. The bore shown in FIG. 6 is open on both ends thereof, but it could also be closed on one end if suitable without departing from the scope of this disclosure. This orientation will permit the crossbeam to be biased into engagement with the sleeves to which it is attached when material is wrapped around the hub formed by the crossbeams.

Figure 5B:
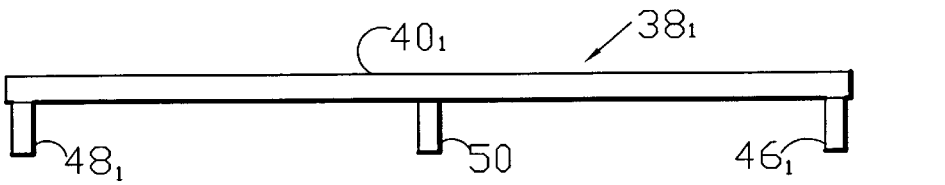
FIG. 5B is an elevational view of another form of crossbeam used in the reel of the present invention.
Figure 5C:
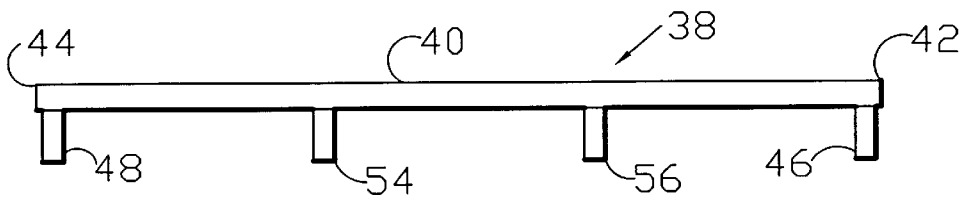
FIG. 5C is an elevational view of another form of crossbeam used in the reel of the present invention.
Figure 5D:
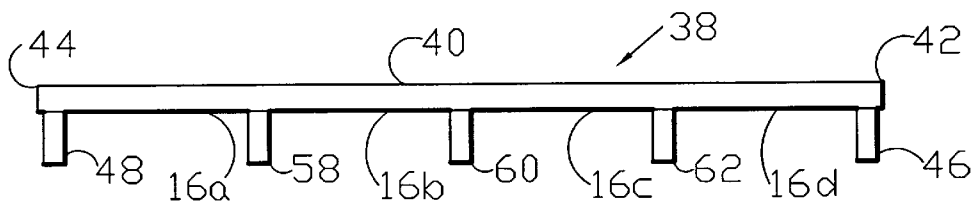
FIG. 5D is an elevational view of another form of crossbeam used in the reel of the present invention.

As can be seen in FIG. 2, one form of the reel of the present invention includes two flanges and a plurality of crossbeams that combine to form a single compartment. However, other forms of the reel can include two, three, four, or more, compartments. These multicompartment reels are easily formed from the same flanges as discussed above with respect to reel 10, by simply combining a crossbeam form with different sleeves and/or by modifying the crossbeams as indicated in FIGS. 5B–5D. As shown in FIG. 5B, a crossbeam $\mathbf{38}_1$ includes a body $\mathbf{40}_1$ having end located projections $\mathbf{46}_1$ and $\mathbf{48}_1$ with a projection 50 located between the end-located projections. Crossbeam $\mathbf{38}_1$ is used to form a two compartment reel $\mathbf{10}_1$ shown in FIG. 7 with projections 50 of crossbeams $\mathbf{38}_1$ being received in sleeves or mounts on a flange 52 located between flanges 12 and 14 and being identical therewith. Compartments $\mathbf{16}_1$ and $\mathbf{16}_2$ are formed between the flanges 12, 14 and 52. The connection between the crossbeam projections and the sleeves on the flanges is identical to that discussed above.

As will be understood from the teaching of this disclosure, reels with three or more compartments can be easily formed using a unitary crossbeam, such as crossbeam $\mathbf{38}_2$ (three compartment) shown in FIG. 5C, or crossbeam $\mathbf{38}_3$ (four compartments) shown in FIG. 5D with each crossbeam having end-located projections and further projections, such as projections 54 and 56 on crossbeam $\mathbf{38}_2$ and projections 58, 60 and 62 on crossbeam $\mathbf{38}_3$ positioned between the end-located projections. As will be understood the number of compartments formed using a unitary crossbeam will be equal to the number of projections minus one (e.g., crossbeam $\mathbf{38}_3$ has five projections, so it will form four compartments, indicated as compartments $\mathbf{16}_a$–$\mathbf{16}_d$ in FIG. 5D).

Figure 7:
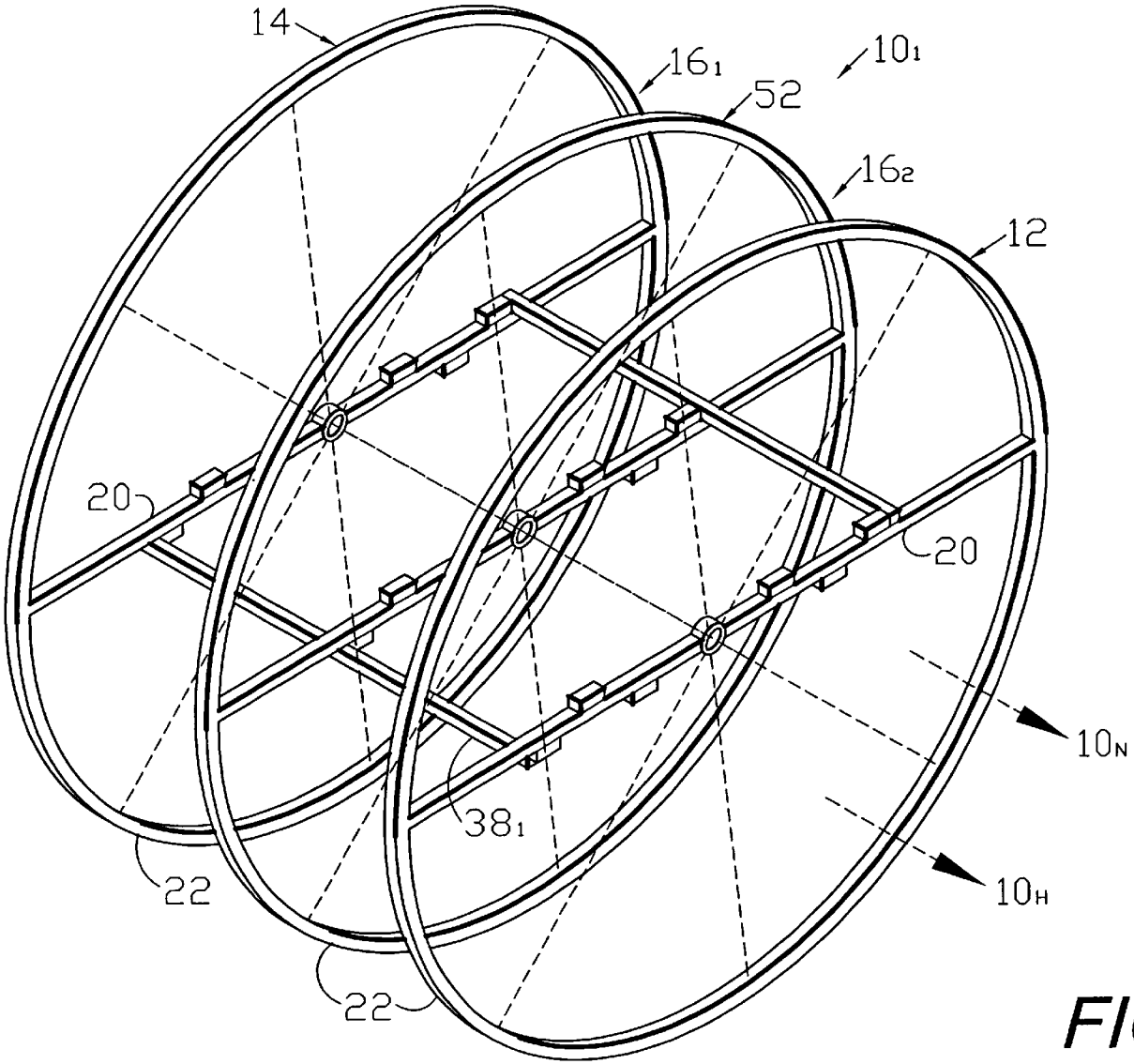
FIG. 7 shows an alternative form of the reel of the present invention with a plurality of compartments.
Figure 7A:
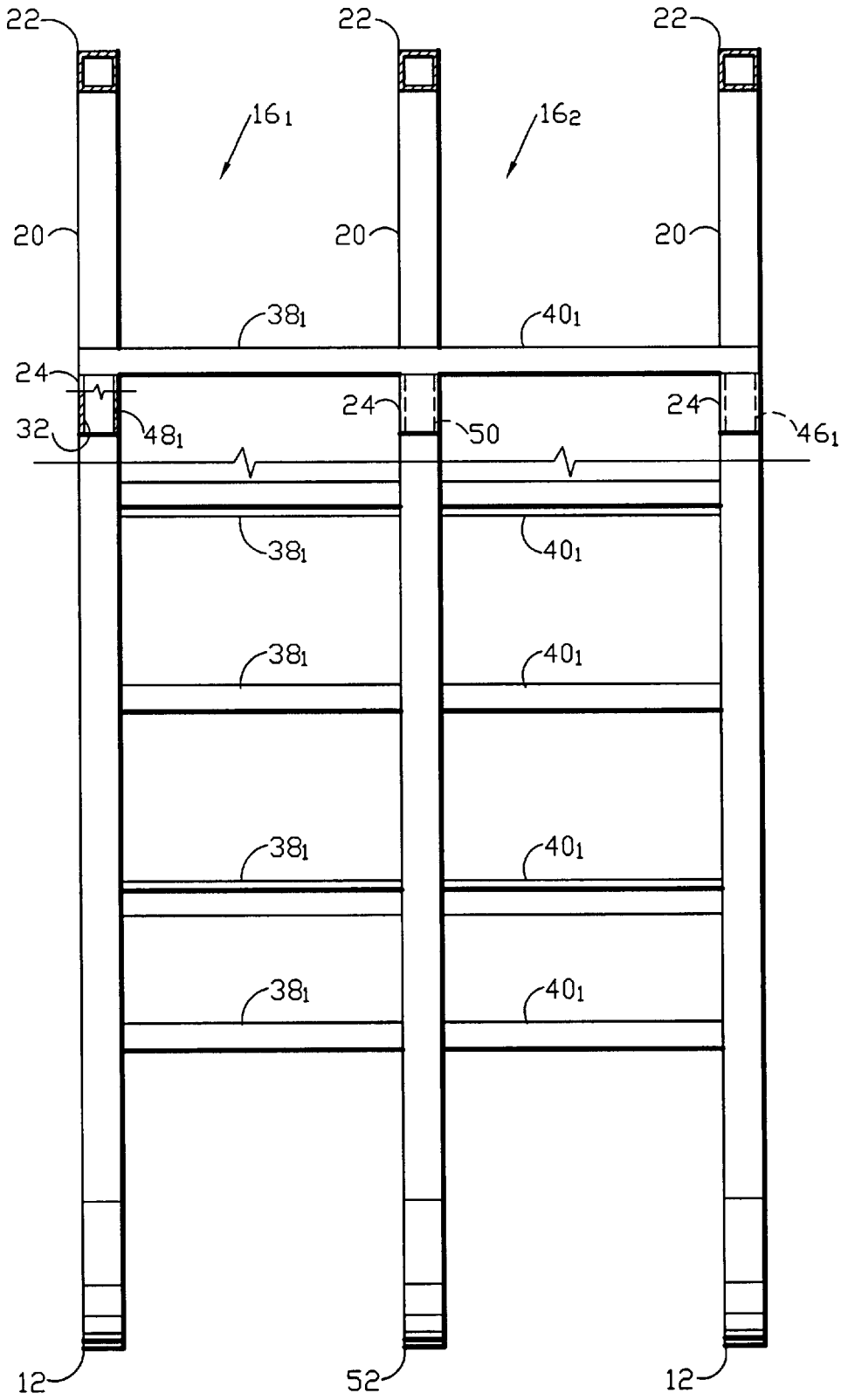
FIG. 7A is an enlarged, elevational view of a portion of the multiple compartment reel shown in FIG. 7.

As indicated by dotted lines 60 in FIG. 7, a reel can include a hub which has different outer peripheral dimensions in each compartment. By using a combination of crossbeams, such as crossbeams $\mathbf{38}_1$ and 38, one hub periphery is defined in one compartment and another hub periphery is defined in an adjacent compartment. For example, using crossbeams 38 connected to sleeves 24 of two adjacent flanges one compartment having a first hub size can be defined, then using crossbeams 38 connected to sleeves 26 of one of the adjacent flanges and another flange a second compartment with a second hub size can be defined, and using still further crossbeams 38 to connect sleeves 28 of the another flange to still another flange, a third compartment with a third hub size can be defined, all for the same reel. The combinations and permutations are nearly endless using the crossbeams 38–$\mathbf{38}_3$ as will be understood from the teaching of this disclosure. Therefore, the single compartment reel shown in FIG. 2 and the two-compartment reel shown in FIG. 7 are only examples of the vast number of reels that can be defined by the interchangeable parts of the reel of the present invention. This is indicated in FIG. 7 by the dotted line arrows indicating that reels $\mathbf{10}_N$ with any number of compartments can be formed and reels with a wide variety of hub peripheral dimensions $\mathbf{10}_H$ can be formed using the interchangeable parts of the reel of the present invention.

It is understood that while certain forms of the present invention have been illustrated and described herein, it is not to be limited to the specific forms or arrangements of parts described and shown.

It is to be understood that while certain forms of the present invention have been illustrated and described herein, it is not to be limited to the specific forms or arrangement of parts described and shown.

What is claimed and desired to be secured by Letters Patent is as follows:

1. A knockdown reel assembly for shipping and/or storing elongate flaccid material, comprising:

two flanges each having a plurality of spokes extending radially outwardly from a central location;

at least one mount on each spoke;

each mount comprising a hollow sleeve with a sleeve body and an open end oriented so the body is located between the open end and said central location;

a plurality of crossbeams, each having a projection on each end thereof; and each projection being releasably received in a mount so said crossbeams form a hub of a reel, said projections being retained in said mounts by said flaccid material wound on said hub.

2. The knockdown reel defined in claim 1 wherein said hub includes a plurality of crossbeams.

3. The knockdown reel defined in claim 2 further including a second flange which includes a plurality of spokes and a plurality of mounts on the spokes of said second flange.

4. The knockdown reel defined in claim 2 wherein each of said mounts includes an open-ended bore sized to slidably receive an extension from one end of the open-ended bore.

5. The knockdown reel defined in claim 2 wherein mounts on each spoke are circumferentially spaced from each other.

6. The knockdown reel defined in claim 3 wherein each crossbeam includes a projection located between the projections on the ends of said crossbeams.

7. The knockdown reel defined in claim 1 wherein mounts on each spoke are located at radially spaced apart locations with respect to each other on that spoke.

8. A knockdown reel assembly for shipping and/or storing elongated flaccid material, comprising:

two first flanges; and an adjustable hub movably and releasably attached to said flanges to define a first compartment between said first flanges and to be movable with respect to said first flanges to adopt a first configuration between said first flanges for accommodating a first material in said first compartment and a second configuration between said first flanges for accommodating a second material in said first compartment and a third configuration for accommodating additional flanges to define a second compartment.

9. The knockdown reel defined in claim 8 wherein said hub is movable into a fourth configuration in said second compartment to accommodate a third material in said second compartment.

10. The knockdown reel defined in claim 9 wherein said hub is removable from said flanges to be in a collapsed configuration.

11. The knockdown reel defined in claim 9 further including a plurality of spokes on each flange, and a plurality of sleeves on each spoke, said hub including a plurality of crossbeams each having a projection on each end thereof which is sized to be releasably received in a sleeve.

12. The knockdown reel defined in claim 8 wherein said hub is removable from said flanges to be in a collapsed configuration.

13. The knockdown reel defined in claim 8 further including a plurality of spokes on each flange, and a plurality of sleeves on each spoke, said hub including a plurality of crossbeams each having a projection on each end thereof which is sized to be releasably received in a sleeve.

14. A knockdown reel assembly for shipping and/or storing elongate flaccid material, comprising:

three flanges, each flange including a plurality of spokes extending radially outward from a central location, and a plurality of hollow sleeves on each spoke, said sleeves being spaced apart from each other, each hollow sleeve having a sleeve body and an open end and being oriented so the body is located between the open and said central location; and a plurality of crossbeams, each crossbeams including an elongate crossbeam body, three projections extending from said crossbeam body with an end projection being located at each end of said crossbeam body and a central projection being located between said end projections;

each of said projections being slidably received in one of said hollow sleeves when a reel is an a set up configuration; and the crossbeams attached to set hollow sleeves forming a central hub that couples said three flanges together and defines two compartments and supports material on said central hub in said compartments with the reel is in a set up configuration.

15. The knockdown reel assembly defined in claim 14 wherein said mounts are radially spaced apart from each other.

16. A knockdown reel assembly for shipping and/or storing elongated flaccid material, comprising:

four flanges, each flange including a plurality of spokes extending radially outward from a central location, and a plurality of hollow sleeves on each spoke, said sleeves being spaced apart from each other, each hollow sleeve having a body and an open end and being oriented so the body is located between the open end and said central location; and a plurality of crossbeams, each crossbeam including an elongate body, four projections extending from said body with an end projection being located at each end of said body and two central projections being located between said end projections;

each of said projections being slidably received in one of said hollow sleeves so that the body of each hollow sleeve slidably receiving a projection is positioned between said crossbeams and said central location when a reel is in a set up configuration; and the crossbeams attached to said hollow sleeves forming a central hub that couples said four flanges together and defines three compartments and supports material on said central hub in said compartments when the reel is in a set up configuration.

* * * * *